US006748703B1

(12) United States Patent
Mandart

(10) Patent No.: US 6,748,703 B1
(45) Date of Patent: Jun. 15, 2004

(54) WAITING AND BOARDING DISEMBARKING STATION FOR URBAN PUBLIC TRANSPORT

(75) Inventor: Didier Mandart, Bischheim (FR)

(73) Assignee: Lohr Industrie, Hangenbieten (FR)

( * ) Notice: Subject to any disclaimer, the term of this patent is extended or adjusted under 35 U.S.C. 154(b) by 0 days.

(21) Appl. No.: 10/110,833

(22) PCT Filed: Oct. 25, 2000

(86) PCT No.: PCT/FR00/02960

§ 371 (c)(1),
(2), (4) Date: Apr. 16, 2002

(87) PCT Pub. No.: WO01/31143

PCT Pub. Date: May 3, 2001

(51) Int. Cl.[7] ..... E04H 1/00

(52) U.S. Cl. ..... 52/36.1; 52/36.2; 52/79.1; 52/DIG. 17

(58) Field of Search ..... 52/36.1, 36.2, 52/79.1, DIG. 17, 64–72

(56) References Cited

U.S. PATENT DOCUMENTS

| | | | | | |
|---|---|---|---|---|---|
| 3,735,536 | A | * | 5/1973 | Bellasalma | 52/261 |
| 3,762,109 | A | * | 10/1973 | Cohen | 52/11 |
| 4,018,016 | A | * | 4/1977 | Zale | 52/36 |
| D252,215 | S | * | 6/1979 | Leuthesser | D25/1 |
| 4,167,838 | A | * | 9/1979 | Metheny | 52/79.1 |
| 4,300,299 | A | * | 11/1981 | Batky et al. | 40/607 |
| D294,300 | S | * | 2/1988 | Hoelterhoff et al. | D25/1 |
| 5,363,608 | A | | 11/1994 | Conlan | |
| 5,669,307 | A | * | 9/1997 | Cichy | 104/28 |
| D406,352 | S | * | 3/1999 | Kleihues | D25/1 |
| 5,986,786 | A | * | 11/1999 | Crandall, Jr. et al. | 359/154 |

FOREIGN PATENT DOCUMENTS

| | | |
|---|---|---|
| FR | 2642879 | 2/1989 |
| FR | 2720431 | 4/1993 |
| FR | 2720432 | 5/1993 |
| FR | 2727444 | 11/1994 |
| FR | 2727945 | 12/1994 |
| FR | 2727445 | 11/1995 |
| GB | 631 566 A | 11/1949 |

OTHER PUBLICATIONS

Maryvonne Dejeammes: "L'Evolution de L'Autobus Dans la Ville Future Evolution of City Buses" Ingenieurs de L'Automobile, FR, RAIP. Boulogne, No. 687, Mar. 1, 1994, pp. 45–48, XP000435036.

* cited by examiner

*Primary Examiner*—Jeanette Chapman
(74) *Attorney, Agent, or Firm*—Davis & Bujold, PLLC

(57) ABSTRACT

The waiting station (1) designed to be set on a sidewalk (2) at the immediate edge of a street or a track comprises a protective wall (29) on its front lateral surface. Access to the station is gained through its lateral surfaces or through the rear. Its interior space is divided into a long-term waiting area (13) preceded by a short-term waiting area (14). This station comprises a passageway for boarding-disembarking that opens on the track side onto a threshold (22) marking the position of an entry door of the vehicle when it is stopped. The threshold (22) is surmounted by a canopy (25) extending from the roof (9) of the station and overhanging the entryway of the vehicle to form a protected access path to the vehicle. This invention is of interest to those responsible for urban planning and to manufacturers of urban equipment and public transportation vehicles.

20 Claims, 7 Drawing Sheets

WAITING AND BOARDING DISEMBARKING STATION FOR URBAN PUBLIC TRANSPORT

FIELD OF THE INVENTION

The present invention relates to a waiting and boarding-disembarking station for urban public transport.

BACKGROUND OF THE INVENTION

People who wish to board an urban public transport vehicle are compelled to await its arrival at any one of the various stops along its itinerary. Some of these boarding and disembarking points have been designed as waiting stations for the comfort of the prospective passengers.

Various types of waiting stations that can be placed along the route of urban public transport systems are known in the art. They generally take the form of a parallepiped shelter with an open front offering the waiting passengers protection from the weather. Shelters such as this have been disclosed in patent application Ser. Nos. FR 2,720,431, FR 2,720,432, FR 2,727,444, and FR 2,727,445. This type of shelter may be closed only on the rear surface and one of its lateral surfaces, as with the shelter described in application FR 2,642,879, offering more limited protection for the waiting passengers.

Certain stations also incorporate seats or benches for longer waiting periods, or for tired or handicapped passengers. This is the case, for example, with the station described and shown in Patent FR. 2,727,945. However, these are not suitable for long waiting periods. Since the space inside the station is restricted, the passengers are constrained in an uncomfortable degree of closeness. In actuality, the seated waiting passengers and the passengers wishing to enter or leave the public transport vehicles are mutually inconvenienced.

SUMMARY OF THE INVENTION

The objective of the invention is to furnish a waiting and boarding-disembarking station with optimal interior space that is divided into one or more long-term waiting zones and a transit zone for rapid access to the public transport vehicle. This improves passengers' comfort and disposition and allows them to stay out of one another's way.

Another objective of the invention is to provide a waiting and boarding-disembarking station offering travelers better protection against the weather while they wait inside the station and until they enter the public transportation vehicle.

With conventional waiting stations, there is very limited protection for passengers against wind and precipitation; in fact, passengers are completely exposed to weather while they are in the area between the shelter and the public transport vehicle when boarding and disembarking.

The waiting and boarding-disembarking station according to the invention comprises a covered structure extending from the roof of the station and overhanging the doorway of the public transport vehicle to form a boarding and disembarking threshold that is protected from the elements.

In addition, the passengers in the long-term waiting are better protected, since the station is better insulated than a conventional shelter.

Conventional stations, which have open fronts, are set back from the edge of the sidewalk to leave a safety zone between the street and the travelers waiting in the station. The free space remaining between the rear of the station and the entryways to houses and buildings, designed for pedestrian traffic, is therefore considerably smaller.

A problem arises in narrow streets where the shelters and conventional stations pose obstacles to pedestrians, who have difficulty finding a path through the often restricted space behind the rear of the station. Some pedestrians decide to detour around the front of the station if there is an object or heavy pedestrian traffic in the narrow passageway. These pedestrians, who are either foolhardy or oblivious, not only expose themselves to a potentially fatal accident, but also disturb the waiting passengers.

Unlike conventional stations and shelters, the waiting station of the invention may be placed right at the edge of the track used by the public transport vehicle. Therefore, a maximum amount of space remains behind it for pedestrians. The travelers waiting inside the stations are completely protected from traffic hazards by a protective wall blocking the front surface of the station facing the street. This wall also prevents passengers from straying too close to the track reserved for the public transport vehicles. The travelers waiting inside the station can no longer walk in the street to access the vehicle. They are compelled to use the boarding-disembarking threshold. In the same way, the people arriving from the sidewalk for immediate boarding and the people disembarking from the public transport vehicle are strongly encouraged to pass through the station by taking the walkway connecting the threshold with the entryway to the station, and they can only walk on the street with difficulty. Therefore, passenger safety is improved considerably.

The present invention, moreover, discloses an embodiment particularly well suited for narrow sidewalks or sidewalks often frequented by pedestrians. According to this embodiment, the station comprises an opening in the rear and/or on one or more of its lateral surfaces for pedestrians to enter the station and pass through without exposure to traffic hazards. Because of the structure and the improved design of the station according to the invention, the travelers waiting inside this embodiment remain protected from the weather and are not disturbed by the passing pedestrians despite these entryways.

To overcome these technical problems, the waiting and boarding-disembarking station of the invention is placed right at the edge of the street. It has a protective wall in the front to protect travelers and prevent them from stepping onto the street. Its interior space is preferably divided into a long-term waiting area surrounded by walls on three sides and with an entryway that opens to the interior of the station rather than onto the street, and a short-term waiting area comprising an entryway to the station and a boarding or disembarking threshold providing protected access to the urban transport vehicle.

The long-term waiting area is particularly well protected in order to insulate the waiting passengers from cold, wind, and inclement weather, as well as from city noise. It also protects them from splashing and traffic hazards. This area is arranged to make the wait more pleasant for travelers. Therefore, it might include individuals seats, benches, back supports, tables, an information display, etc.

The short-term waiting area, designed to accommodate passengers ready to embark, contains fewer items. It has no seats, but it may have back supports or rails and restraining devices, such as hand rails. Wheelchairs, strollers, baby carriages, and the like can be easily maneuvered for boarding or are disembarking from the public transportation vehicle without bumping into the passengers seated in the long-term waiting area or disturbing them.

The short-term waiting area is preferably followed by an intermediate space or an threshold for access to the door of the public transportation vehicle protected by a canopy structure extending from the station roof which shelters the passengers until they enter the vehicle or conversely, from the time they exit the vehicle until they enter the station.

The waiting station of the invention is also modular. One or more long-term or short-term waiting areas can be added, comprising one or more vehicle access thresholds. Thus, the station might have one threshold for each of the vehicle doors. The station can also be modified transversely and it might comprise an access threshold on each side of the station so a passenger can elect to board any one of several public transportation vehicles traveling in the opposite direction or to transfer to different lines.

BRIEF DESCRIPTION OF THE DRAWINGS

Other characteristics and features of the invention will be apparent from the following detailed description, with reference to the attached drawings, in which.

DETAILED DESCRIPTION OF THE INVENTION

Figure 1:
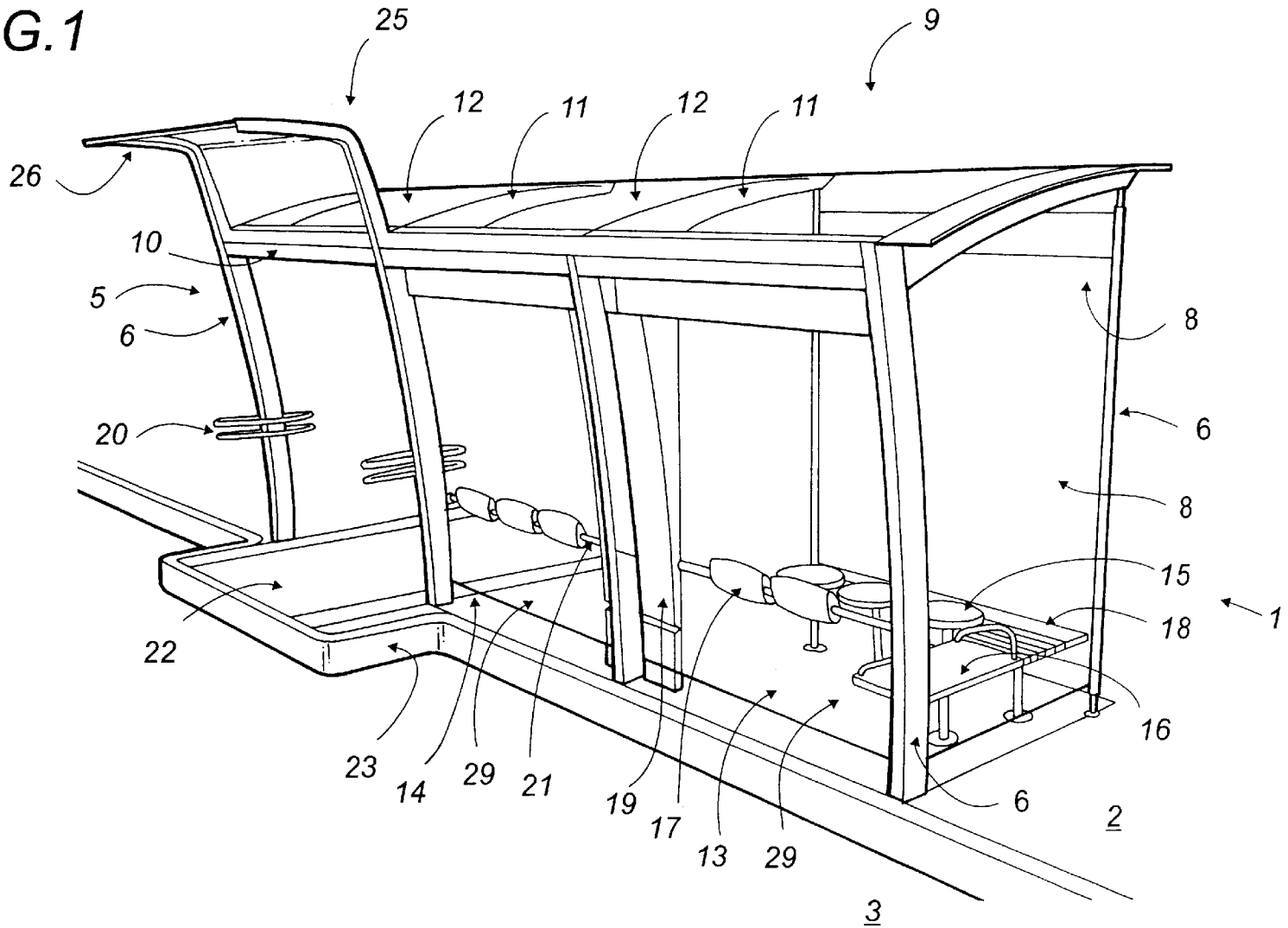
FIG. 1 is a front perspective of a first embodiment of the waiting station according to the present invention.
Figure 2:
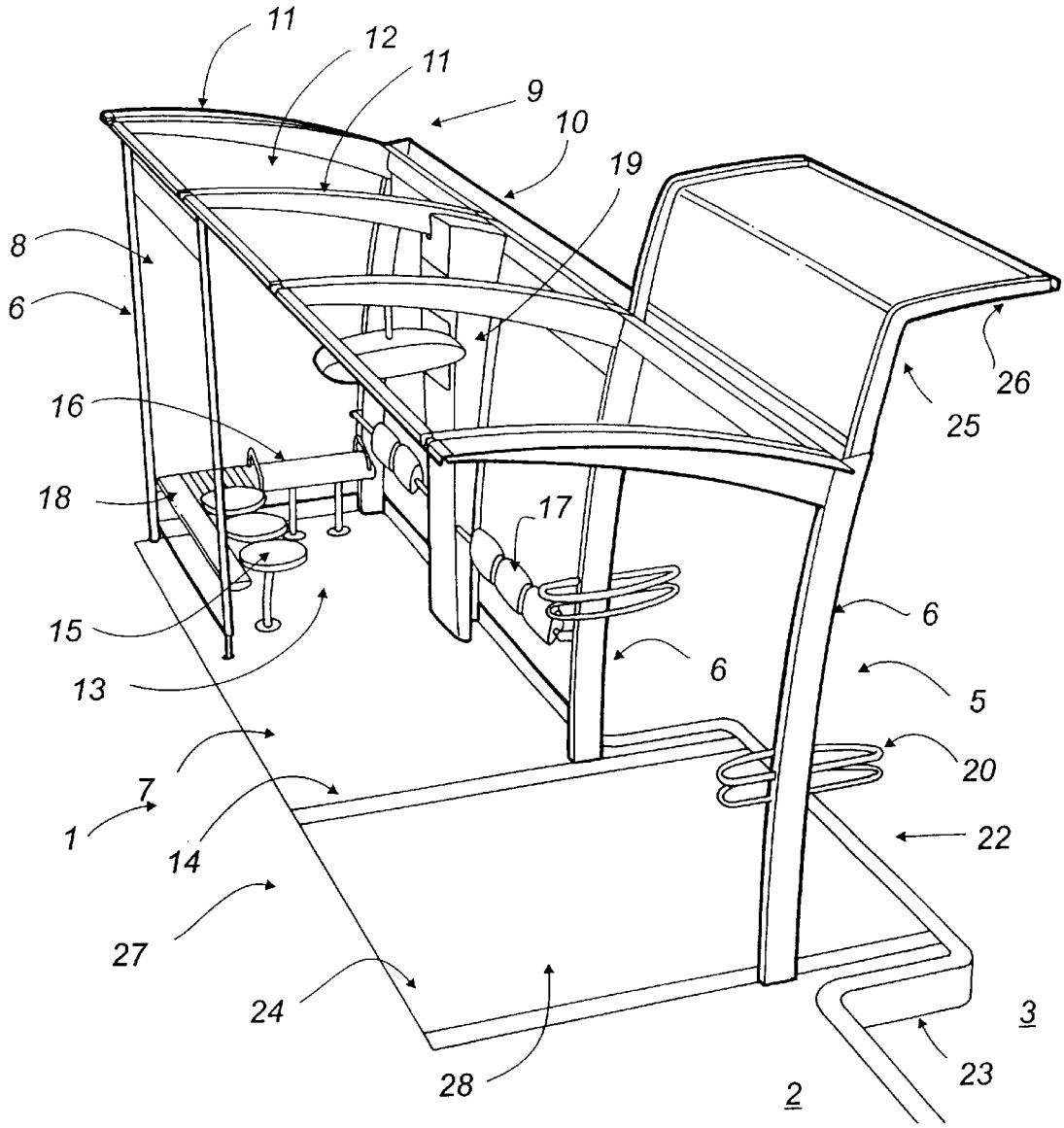
FIG. 2 is a rear perspective of the first embodiment of the waiting station according to the present invention.
Figure 3:
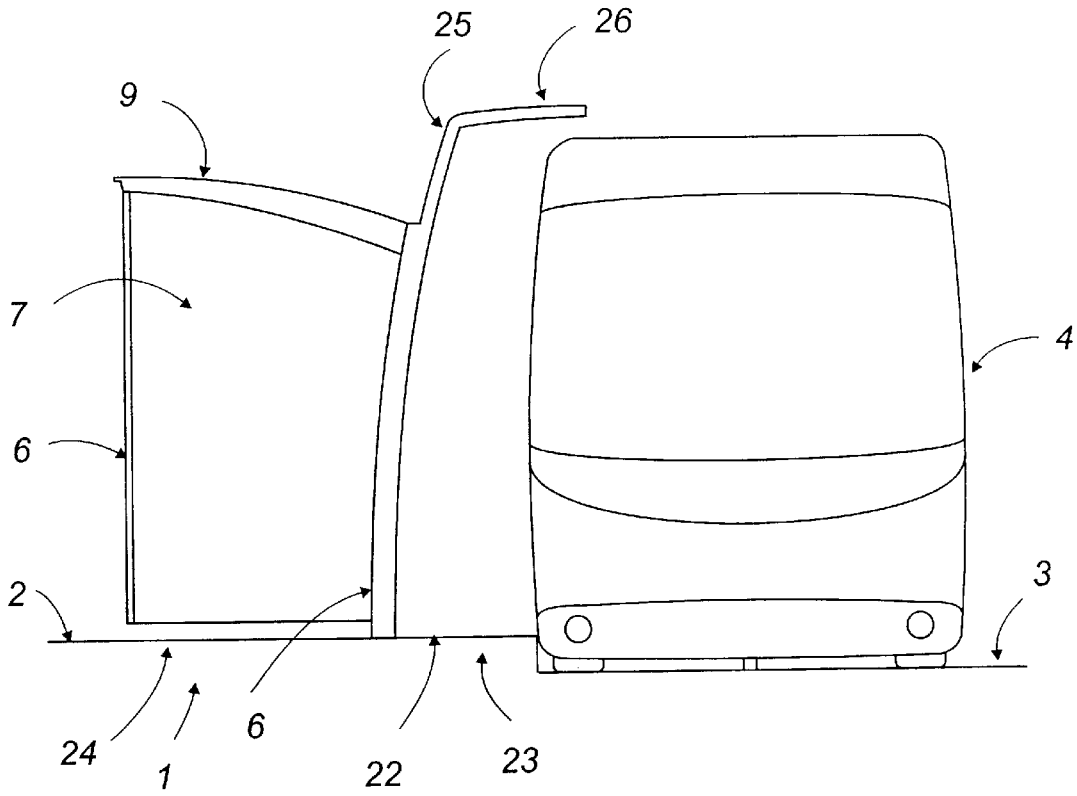
FIG. 3 is a schematic view showing a public transportation vehicle parked next to the covered boarding/disembarking threshold of the waiting station.
Figure 4:
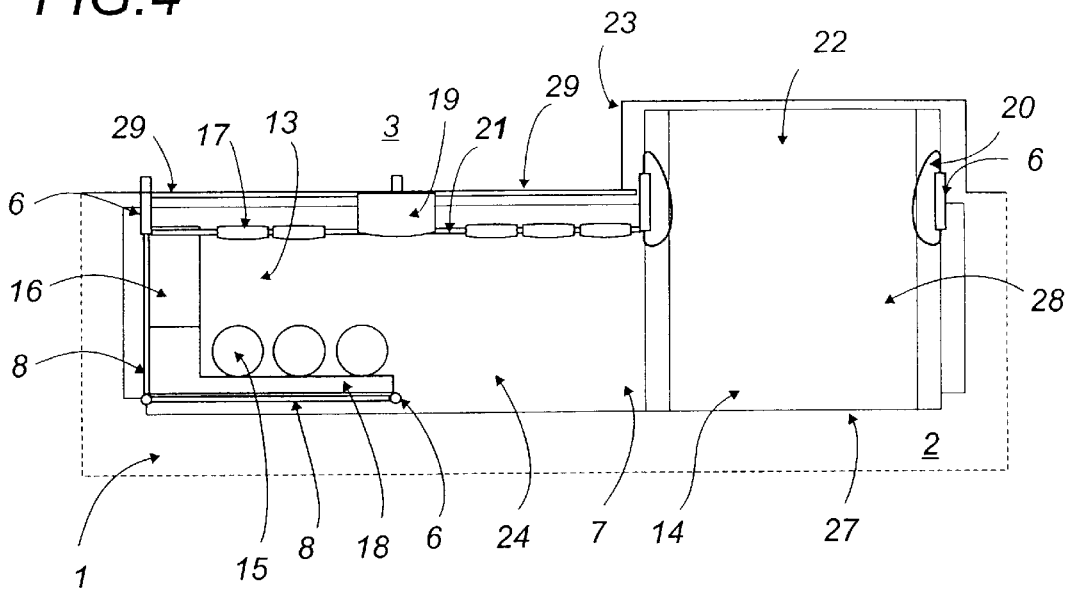
FIG. 4 is a schematic plane view of a first embodiment of the station according to the invention.

The waiting station of the present invention is designed for a public transportation system in a relatively congested area. Thus, it is possible to have various related embodiments which will be described in detail below. Equivalent elements shown in different drawings will have the same reference numerals. These embodiments vary from one another in terms of size, modifications, or various added elements. However, the essential general functions remain identical.

First, the basic variation of the station of the invention will be described with reference to FIGS. 1 through 4.

According to the basic variation, waiting station 1 is designed to be placed on a sidewalk 2 at the edge of a street or a track 3 traveled by a public urban transport vehicle 4. Vehicle 4 can be of any type whatsoever. For example, it may be a bus, a motor coach, a subway or tram, a self-guided road vehicle or any other urban passenger transport vehicle. Street 3 might be a conventional street for automobile traffic. It may also comprise equipment required for a public transportation vehicle 4, such as for example, traffic or guide rails circulation or guide rails. Since these items are not part of the invention, they are not shown in the different drawings. Street 3 may also be reserved exclusively for public urban transport traffic and sidewalk 2 may consist of a platform bordering the public transportation track.

In the first embodiment shown in FIGS. 1 through 4, the general shape of waiting station 1 is globally parallelepiped.

It has a metal shell 5 comprising several upright portions or supporting posts 6—which are generally vertical and located near the exterior surfaces of the station, defining the station's interior space 7. There may be six such supports, as shown in FIGS. 1 through 4. Between certain supports there are vertical walls 8 insulating the interior station space so that it forms a closed shelter for the waiting passengers. Walls 8 consist of panels made of some transparent or translucent material such as glass or a plastic substance in order to offer visibility to the outside and to let light enter. Panels 8 can also provide a surface for posting displays or documents informing passengers about schedules, prices, or public transportation routes.

The station's interior is protected by a roof structure 9 that rests partially on a horizontal metal beam 10 extending longitudinally from the station between the vertical supports 6 and which also comprises a network of metal cross pieces 11, perpendicular to beam 10 and located in a generally horizontal plane. The station's roof structure 9 may also consist of several glass or transparent plastic panels 12.

The interior 7 of the station according to the invention is divided into a long-term waiting area 13 and a short-term waiting area 14.

The long-term waiting area 13 is either completely or partially surrounded by wall 8 on three of its sides and it opens to the interior of the waiting station. Thus, it is particularly well suited to protecting the waiting passengers from inclement weather, cold, wind, and city noise. This area is appointed to make the waiting time more pleasant for travelers. For example, it may be furnished with individual seats 15, benches 16, back supports 17, work tables, or counters 18 where travelers can place their belongings. This area might also include a bulletin display, an automatic ticket dispensing and/or validating unit 19, vending machines for food, beverages, tickets or change, or any other simple or interactive device which would be useful to the passengers and make their wait more agreeable. This area might be arranged as shown in FIG. 14, although this arrangement is not limitative.

This area makes the time useful and more comfortable for passengers who must wait to board a public transportation vehicle. It can also serve as a meeting place or a protected rest area that is fully integrated into the urban landscape, providing a place where tired pedestrians and walkers can sit comfortably and rest a few minutes.

Waiting and boarding-disembarking station 1 according to the invention also comprises a short-term waiting area 14 for passengers ready to board the public transportation vehicle. For this reason it is furnished much more simply than the long-term waiting area. It has no seats, but it may be equipped with back supports 17 or grips and restraining devices 20, for example, handrails on the vertical supports 6, on horizontal bars 21 or walls 8. Thus, travelers can easily maneuver wheelchairs, strollers, and other baby equipment, as well as suitcases on wheels or any other bulky object as they prepare to board a public transportation vehicle 4 without bumping into or disturbing the passengers who are seated in the long-term waiting area 13.

The short term waiting area 14 is relatively empty and contains no large items. It extends longitudinally into a transverse passageway marked by an indicator on the ground. This passageway extends near the track into an intermediate space 22 between the body of the station and the vehicle or a boarding-disembarking threshold 22 formed of a transverse projection 23 from the floor 24 of the station onto the edge of track 3, constituting an extension of sidewalk 2, a covering, and a sheltered, lateral guided passageway for passengers leaving or arriving. Thus, there is direct access to the vehicle door with no change in level, at the same level, which facilitates boarding and disembarking for all passengers and is particularly advantageous for the elderly, handicapped, or those accompanied by small children or carrying large, heavy objects.

This projection 23 marks the position of the entry or exit doorway of the public transportation vehicle when it stops at the station.

The intermediate area 22 is bordered by sheltered structures and guided walkways on either side of the threshold.

The intermediate boarding-disembarking space or threshold 22 has a closed upper portion and it is protected all the way to the vehicle by a curved canopy structure 25 extending locally and elevated from the station roof 9. When public transportation vehicle 4 stops at the waiting station of the invention, the exterior extremity 26 of canopy 25 partially covers the vehicle near its entry door so as to shield the passengers from the weather until they are inside the vehicle, or until they disembark. This advantageous feature of the invention is shown more particularly in FIG. 3.

The front section of waiting station of the invention located opposite the track or the street 3 is closed as far as the intermediate boarding-disembarking area 22 by a longitudinal separation near the track. This separation, forming the longitudinal lateral front wall of the station, at least partially blocks the surface of the station located opposite the track. It may be made of vertical panels 8 constituting a lateral longitudinal protective wall 29 which protects the passengers in the long- and short-term waiting areas from splashes or traffic hazard and isolates them from the track reserved for the public transportation vehicles. Because of this protective wall 29, the passengers waiting inside the station cannot walk along the exterior, track side of the station and are obliged to use the boarding threshold 22 to access the vehicle, a feature designed for the safety of passengers.

This protective wall also allows the station to be set closer to the track, leaving an extremely narrow area on the front, track side defining the edge and freeing additional space at the rear of the station.

The waiting station has a main entryway 27 at the rear so people walking along the sidewalk 2 can pass through the short-term waiting area 14. Main entryway 27 is located opposite the protected boarding-disembarking threshold 22, placing threshold 22 in direct communication with sidewalk 2 through a direct, functional interior walkway 28 traversing it which may be marked by a symbol on the floor. Passengers who arrive just in time to board the vehicle can move quickly from the sidewalk 2 to the public transportation vehicle without any detours by using internal access walkway 28 which passes through the station transversely and then using the boarding threshold 22. Likewise, passengers disembarking from the public transportation vehicle step onto threshold 22 and easily reach the sidewalk using internal access walkway 28 without any interference from waiting passengers, objects in the station, or dividing walls. This problem often encountered in conventional bus shelters and obliging the disembarking passengers to detour around the shelter and sometimes walk carelessly in the street, is eliminated.

Thus, passengers arriving from inside the station, from the sidewalk or from the vehicle are channeled and forced to use the secure, practical and direct internal access walkway 28. Passengers are discouraged from walking around the front of the station not only by the extremely narrow space between the station and the track, but also because there is equipment such as guardrails, barriers and handrails or guide rails 20 along embarking threshold 22 which form obstacles to restrain the passengers and assist them in passing over the threshold.

Figure 8:
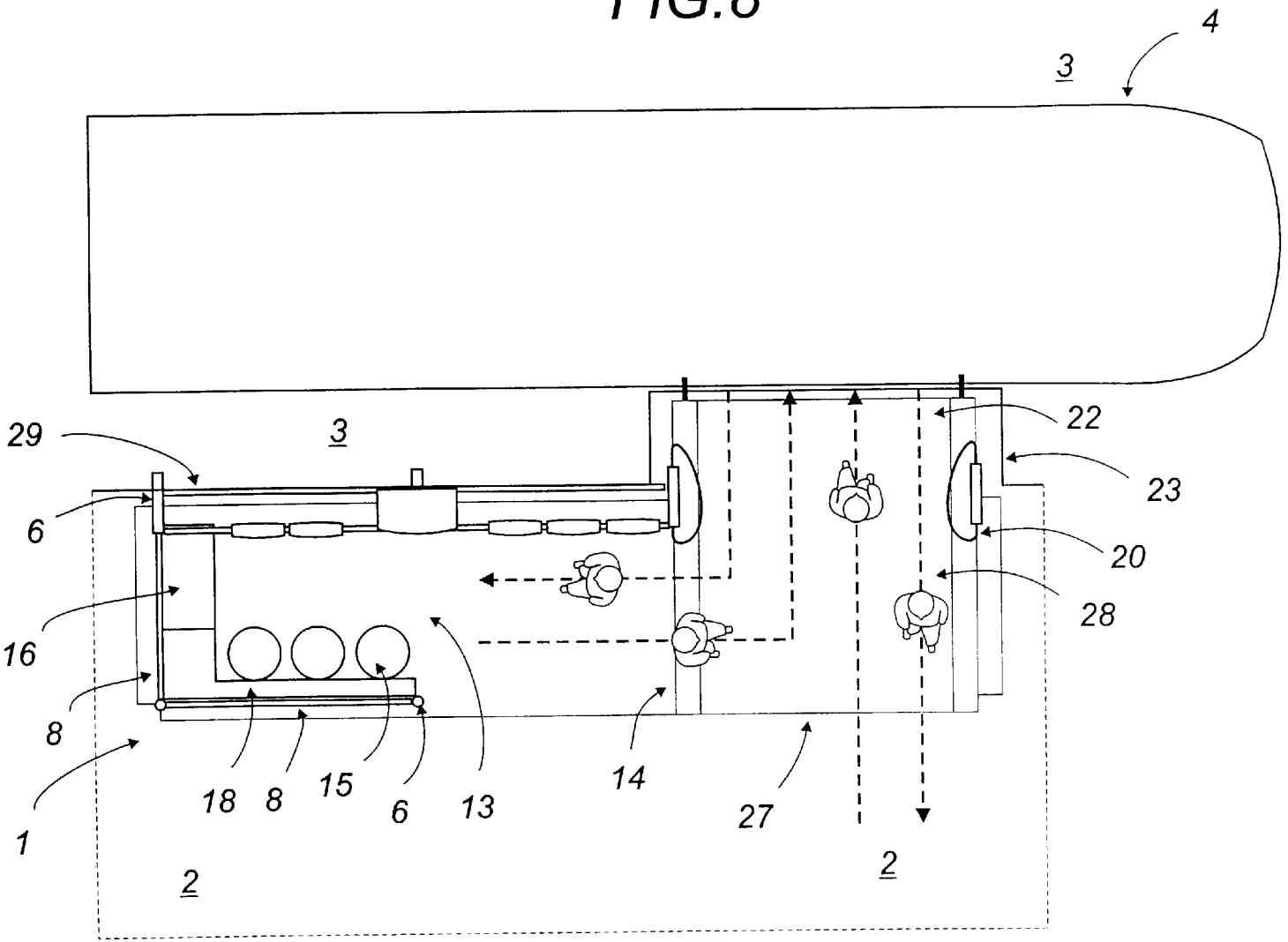
FIG. 8 is a schematic plane view of the first embodiment of the station of the invention showing the secured areas for the passengers to pass between the public transportation vehicle and the station, and between the public transportation vehicle and the street through the station.

The secure passenger walkways between the station interior and the public transportation vehicle and between the sidewalk and the public transportation vehicle are designated by arrows in FIG. 8.

Figure 5:
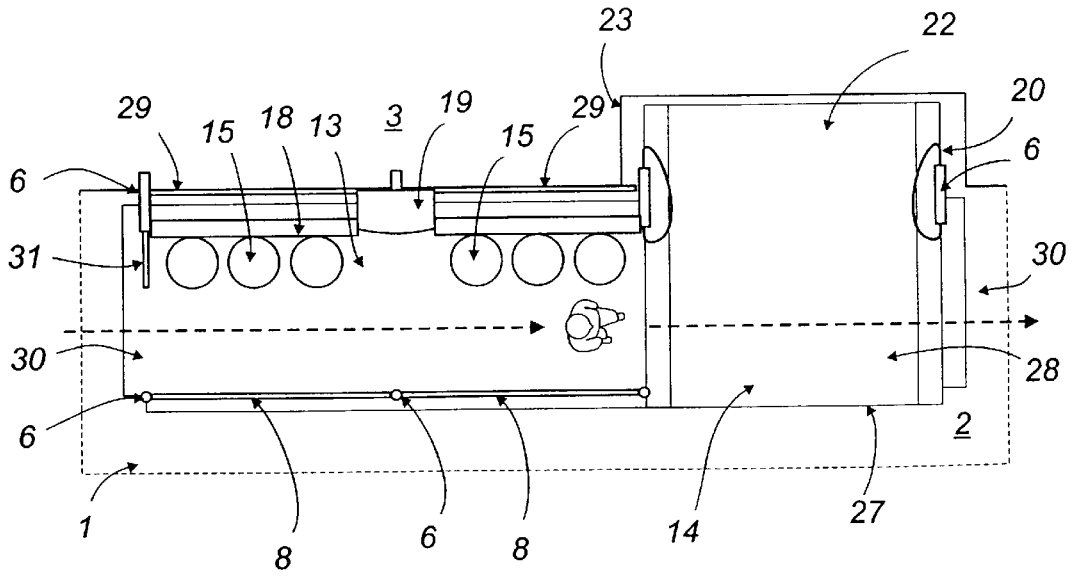
FIG. 5 is a schematic plane view of a second embodiment of the station of the invention specifically designed to be placed on narrow or heavily traveled sidewalks.

FIG. 5 illustrates a second embodiment of the waiting station of the invention, specifically designed to be placed on a narrow sidewalk or in high traffic pedestrian zones. The waiting station according to the second embodiment has a globally parallelepiped structure very similar to the structure described previously. Its interior space 7 is also divided between a long-term waiting area 13 and a short-term waiting area 14. The short-term waiting area 14 has an entryway 27 in the rear and an intermediate space or boarding-disembarking threshold 22 in the front shielded by a canopy 25, located at the two extremities of an internal access walkway transverse to the station and connecting the sidewalk 2 directly to the public transport vehicle 4.

To prevent it from posing an obstacle for pedestrians walking along the sidewalk, each lateral surface of the station according to this embodiment has an opening 30 allowing pedestrians to pass through the inside of the waiting station. Pedestrians can enter the waiting station, pass through it longitudinally and leave through the other side without making any detours and without disturbing or being disturbed by the waiting passengers. They can therefore pass through the station without being exposed to traffic hazards. The pedestrian walkway through the station is shown by arrows in FIG. 5.

Despite lateral opening 30, the lateral surface of the long-term waiting area remains partially closed along one edge by a wall portion 31. This wall portion protects one of the longitudinal surfaces of the station where the seats 15, benches and other appurtenances of the long-term waiting area are arranged along the wall.

Conversely, the corresponding longitudinal surface on the open side of the lateral surface has no seats or similar items. It remains empty so pedestrians can circulate freely through the waiting station or so occupants can remain standing if it is crowded.

Because of the improved structure and disposition of this embodiment of the station according to the invention, and despite lateral openings 30, the waiting passengers remain relatively protected from the weather and are not bothered by the pedestrians who pass freely through the station.

This embodiment is very successful, despite the fact that the station is placed as close to the street as possible, if the free space on the sidewalk between the fixed elements and the station remains narrow or if there is a heavy concentration of passengers inside the passageway. Because it is possible for pedestrians to pass through the waiting station, there is no need for them to take a dangerous detour around it through the street.

Figure 6:
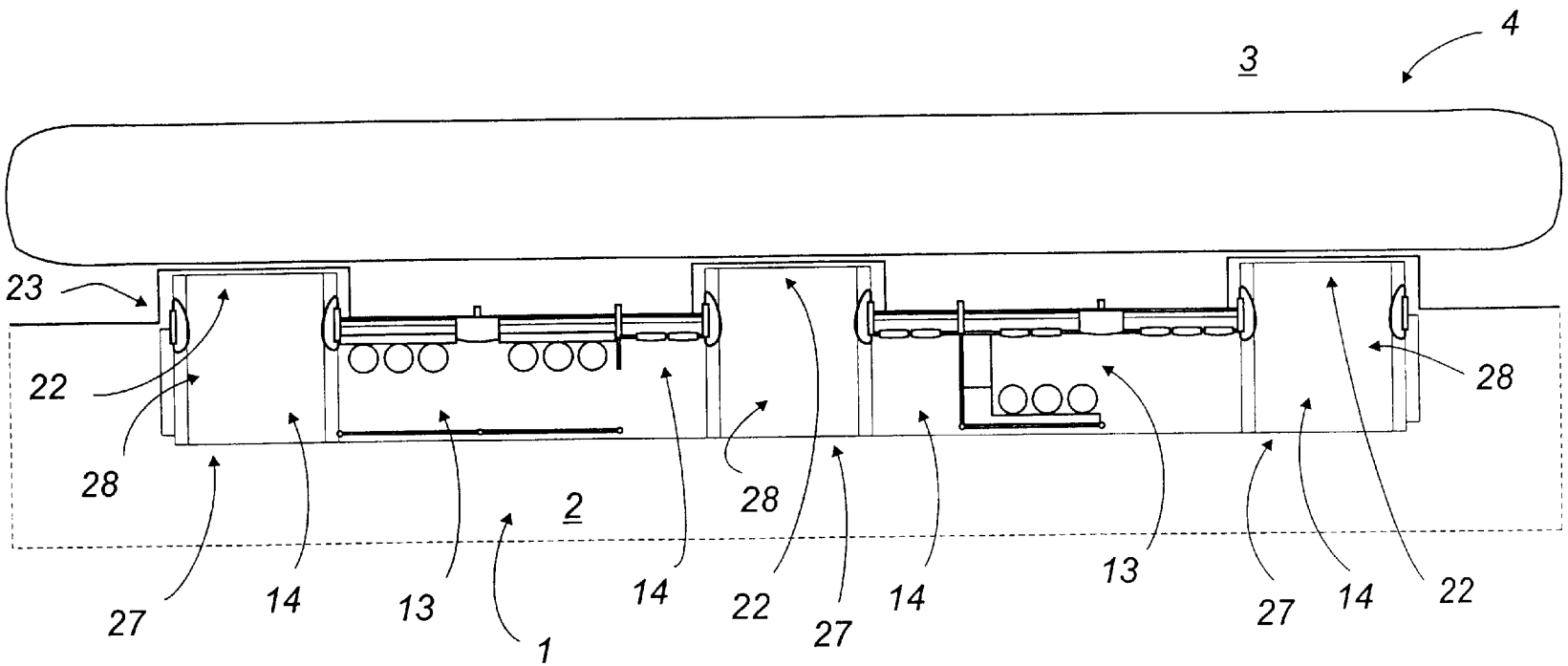
FIG. 6 is a schematic plane view of a third embodiment of the station of the invention comprising two long-term waiting areas and three vehicle access thresholds.
Figure 7:
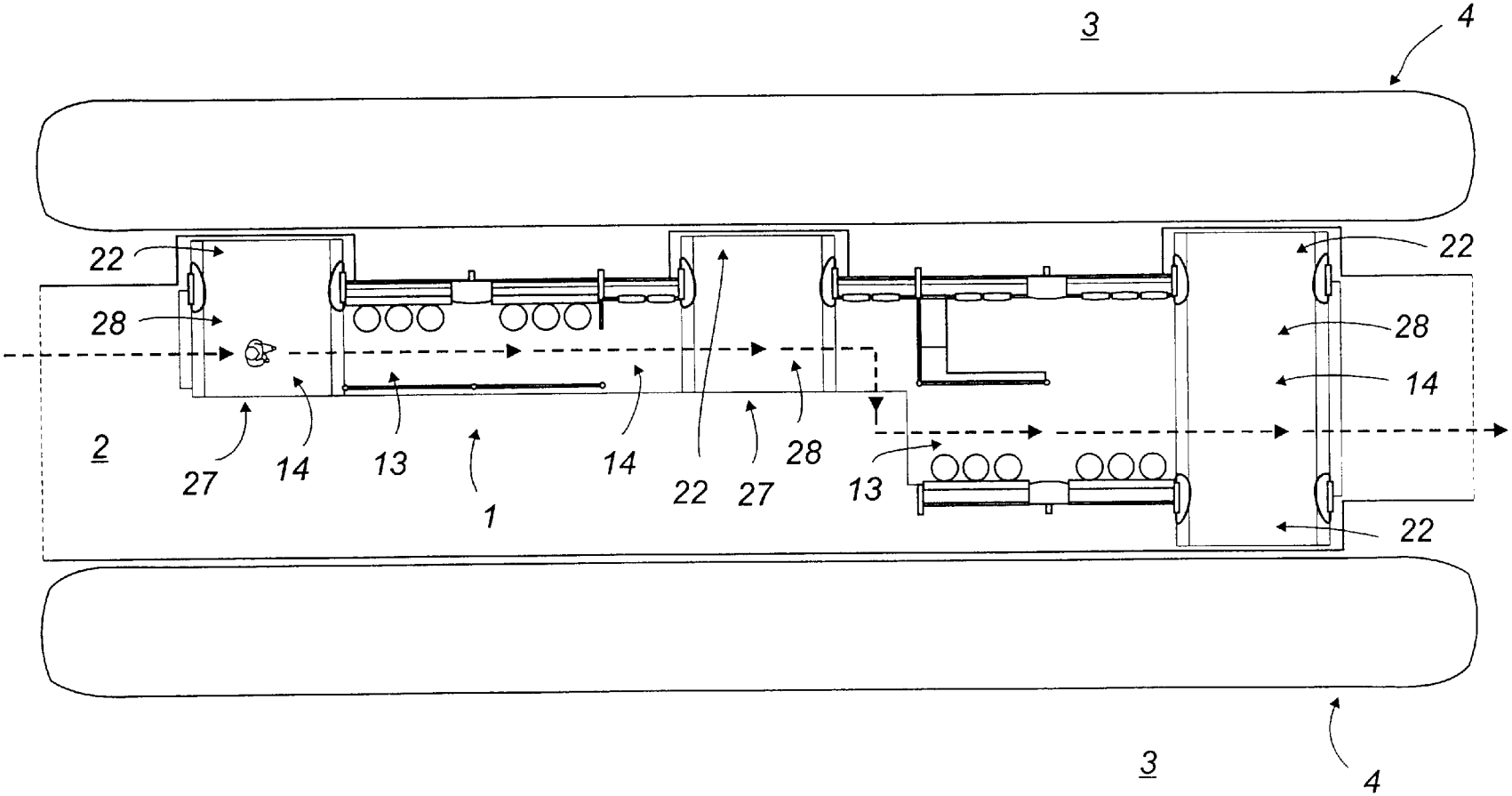
FIG. 7 is a schematic plane view of a fourth embodiment of the station according to the invention comprising two long term waiting areas and four boarding-disembarking thresholds located on either side of the station offering access to two different public transportation vehicles.

FIGS. 6 and 7 show two other embodiments with various modifications and additions to the previous embodiments, but whose essential features remain identical. These two other variations are merely non-limitative examples demonstrating the modular features of the station according to the present invention.

According to these variations, several other waiting areas and boarding-disembarking thresholds have been added to the basic station previously described in order to enlarge it longitudinally or transversely.

The variation shown in FIG. 6 is designed specifically for high traffic areas; it may comprise three covered boarding-disembarking thresholds 22 denoting the location of the doors of the public transportation vehicle when it stops, allowing passengers to simultaneously access either several different public transportation vehicles or several doors to the same vehicle. There are three doors offering simultaneous access, which might correspond to three successive cars on the same urban transport train.

This station, which is longer than the preceding ones, consists of several areas like those described previously. From left to right, they consist of: a first embarking threshold 22, a transverse long-term waiting area 13, a small short-term waiting area 14, a second embarking threshold 22, a second small short-term waiting area 14, a closed long-term waiting area 13, and a third embarking threshold 22. This station has three entryway openings 27 in the rear located opposite each embarking threshold 22, providing direct access from the sidewalk to the public transportation vehicle through three interior access walkways 28.

The embodiment in FIG. 7 is identical to that of FIG. 6, but it further comprises a transverse long-term waiting area 13 and a boarding-disembarking threshold 22. This station is formed of a simple station with a combination station added to it comprising two passageways on each side, one being a mixed passageway with four entries/exits, two of which are back-to-back and open onto the tracks along the station. These additions, consisting for example, of two supplementary elements joined to the second long-term waiting area 13 and to the third embarking threshold 22 of the previous embodiment, enlarge the station transversely and form a large capacity station.

This embodiment is perfectly suited for a specialized station set on a central sidewalk between two tracks used by public transport vehicles in a transfer zone, a traffic junction, or for changing direction. The latter two boarding thresholds 22 actually communicate and extend out from each other, offering simultaneous access to two tracks along either side of the central sidewalk. Passengers can thus board several public transport vehicles, for example, when transferring. This embodiment also makes it possible to provide only a single waiting station for each stop along a public transportation line, rather than two shelters, one corresponding to each direction of travel by the public transport vehicle along the line. This enlarged waiting station can also serve as a stopping point for several public urban transportation lines.

The entire station, as shown in FIG. 7, is accessible to pedestrians. The pedestrian walkways are shown by the arrows. Pedestrians are not required to take any impractical or dangerous detours.

The waiting station, according to the invention, can be modified at will to respond to different needs or desires of a particular situation. One or more long-or short-term waiting areas can be added either longitudinally or transversely, as well as one or more vehicle access thresholds. The interior arrangements and appurtenances can also be modified. However, the variations that result from these various modifications, additions, or omissions retain the essential features of the invention and do not exceed the scope of the invention as defined in the claims.

What is claimed is:

1. An elongate waiting and boarding-disembarking station designed to extend longitudinally along and be located directly adjacent a border between one of a sidewalk (2) and a platform and one of a street and a track (3) for an urban passenger transport vehicle (4), the waiting and boarding-disembarking station extending substantially parallel to and directly along the border between one of the sidewalk (2) and the platform and one of the street and the track (3) for providing shelter for at least one passenger waiting to board the urban passenger transport vehicle (4), the waiting and boarding-disembarking station comprising a metal shell (5) supporting at least one lateral wall panel (8) and at least one roof panel (12) for defining a partially enclosed covered space (7):

wherein at the lateral wall panel (8) is a longitudinal separating wall (29) provided along a front of the waiting and boarding-disembarking station which is designed to be positioned so as to extend substantially parallel to and directly along the border between one of the sidewalk (2) and the platform and one of the street and the track (3), the longitudinal separating wall (29) has an opening therein which forms a vehicle access threshold (22) for passenger use, and the longitudinal separating wall (29) forms a barrier which separates, except for the one opening, the front surface of the station from one of the street and the track (3);

the waiting and boarding-disembarking station, when the front surface of the waiting and boarding-disembarking station is positioned directly adjacent the border between one of a sidewalk (2) and a platform and one of a street and a track (3), prohibits passenger traffic between the longitudinal wall (29) of waiting and boarding-disembarking station and one of the street and the track (3);

a portion of the covered space (7), adjacent the longitudinal separating wall (29), forms a waiting area which protects at least one waiting passenger from one of the street and the track (3); and the waiting and boarding-disembarking station is at least partially open along at least one other surface, other than the front surface, which allows people traveling along one of the sidewalk (2) and the platform to enter and exit from the waiting and boarding-disembarking station.

2. The waiting and boarding-disembarking station according to claim 1, wherein the vehicle access threshold (22) is closed at an upper portion in order to shield at least one passenger until the at least one passenger one of enters and disembarks from the urban transport vehicle (4).

3. The waiting and boarding-disembarking station according to claim 2, wherein the vehicle access threshold (22) is closed, at the upper portion thereof, by a canopy (25) constituting an extension of the roof structure (9) of the waiting station.

4. The waiting and boarding-disembarking station according to claim 2, wherein an exterior extremity (26) of the canopy (25) extends transversely from the station beyond the vehicle access threshold (22) so the canopy (25) partially covers the urban passenger transport vehicle (4) when the urban passenger transport vehicle (4) is stopped at the waiting and boarding-disembarking station for one of boarding and disembarking of at least one passenger.

5. The waiting and boarding-disembarking station according to claim 1, wherein the vehicle access threshold (22) is level with a floor of the waiting and boarding-disembarking station, allowing at least one passenger to one of board and disembark on one level, and the vehicle access threshold (22) comprises a projection (23) extending from a base (24) of the waiting and boarding-disembarking station toward one of the street and the track (3).

6. The waiting and boarding-disembarking station according to claim 1, wherein a path Inside the waiting and boarding-disembarking station, between the station entryway (27) and the vehicle access threshold (22), is marked by one of an indicator, a reference and a guide symbol to direct at least one passenger toward the transport vehicle (4).

7. The waiting and boarding-disembarking station according to claim 1, wherein the vehicle access threshold (22) is bordered on either side by one of a protective guide means and a protective guide structure.

8. The waiting and boarding-disembarking station according to claim 1, wherein the waiting area, bordered by the longitudinal separation wall (29), is divided into a long-term waiting area (13) and a short-term waiting area (14).

9. The waiting and boarding-disembarking station according to claim 8, wherein the long-term waiting area (13) is surrounded by walls (8) which at least partially block three sides of the long-term waiting area (13).

10. The waiting and boarding-disembarking station according to claim 8, wherein the entryway, opening to the long-term waiting area (13), opens into the interior of the waiting and boarding-disembarking station.

11. The waiting and boarding-disembarking station according to claim 8, wherein the long-term waiting area (13) has at least one of individual seats (15) and elongate benches (16) for at least one Waiting passenger.

12. The waiting and boarding-disembarking station according to claim 8, wherein the short-term waiting area (14) is free of equipment for at least one waiting passenger.

13. The waiting and boarding-disembarking station according to claim 1, wherein a principal entryway (27) to the waiting and boarding-disembarking station and the vehicle access threshold (22) are located on opposite sides of the waiting and boarding-disembarking station.

14. The waiting and boarding-disembarking station according to claim 1, wherein each of the two lateral surfaces of the waiting and boarding-disembarking station comprises a lateral opening (30) allowing pedestrians to longitudinally traverse the waiting station.

15. The waiting and boarding-disembarking station according to claim 14 wherein despite the lateral opening (30), the lateral surface of the long-term waiting area (13) remains partially closed along at least one of its sides by a portion (31) of wall protecting one of the longitudinal surfaces of the long-term waiting area (13).

16. The waiting and boarding-disembarking station according to claim 1, wherein the waiting and boarding-disembarking station comprises several vehicle access thresholds (22) for providing at least one passenger with access to the at least one urban transport vehicle (4).

17. The waiting and boarding-disembarking station according to claim 16, wherein vehicle access thresholds (22) are located on at least two of surfaces of the waiting and boarding-disembarking station.

18. The waiting and boarding-disembarking station according to claim 1, wherein the waiting area bordered by the longitudinal separating wall (29) Is divided into at least one long-term waiting area (13) and at least one short-term waiting area (14).

19. An elongate waiting and boarding-disembarking station designed to extend longitudinally along and be located directly adjacent a border between one of a sidewalk (2) and a platform and one of a street and a track (3) for an urban passenger transport vehicle (4), the waiting and boarding-disembarking station extending substantially parallel to and directly along the border between one of the sidewalk (2) and the platform and one of the street and the track (3) for providing shelter for at least one passenger waiting to board the urban passenger transport vehicle (4), the waiting and boarding-disembarking station comprising a metal shell (5) supporting at least one lateral wall panel (8) and at least one roof panel (12) for defining a partially enclosed covered space (7):

wherein at the lateral wall panel (8) is a longitudinal separating wall (29) provided along a front of the waiting and boarding-disembarking station which is designed to be positioned so as to extend substantially parallel to and directly along the border between one of the sidewalk (2) and the platform and one of the street and the track (3), the longitudinal separating wall (29) has an opening therein which forms a vehicle access threshold (22) for passenger use, and the longitudinal separating wall (29) forms a barrier which separates, except for the one opening, the front surface of the station from one of the street and the track (3);

the waiting and boarding-disembarking station, when the front surface of the waiting and boarding-disembarking station is positioned directly adjacent the border between one of a sidewalk (2) and a platform and one of a street and a track (3), prohibits passenger traffic between the longitudinal wall (29) of waiting and boarding-disembarking station and one of the street and the track (3);

a portion of the covered space (7), adjacent the longitudinal separating wall (29), forms a waiting area which protects at least one waiting passenger from one of the street and the track (3);

the waiting and boarding-disembarking station is at least partially open along at least one other surface, other than the front surface, which allows people traveling along one of the sidewalk (2) and the platform to enter and exit from the waiting and boarding-disembarking station;

the vehicle access threshold (22) has a projection (23) extending from a base (24) of the waiting and boarding-disembarking station toward one of the street and the track (3); and a canopy (25) forms a roof extension of the roof panel and the canopy (25) extends transversely of the station beyond the projection (23) of the vehicle access threshold (22) so that the canopy (25) partially covers the urban passenger transport vehicle (4) when the urban passenger transport vehicle (4) is stopped at the waiting and boarding-disembarking station, for one of boarding and disembarking at least one passenger.

20. A waiting and boarding-disembarking station designed to be set longitudinally along one of a sidewalk (2) and a platform that is essentially parallel to and borders one of a street and a track (3) for an urban passenger transport vehicle (4), the waiting and boarding-disembarking station providing shelter for at least one passenger waiting to board the urban passenger transport vehicle, the waiting and boarding-disembarking station comprising a metal shell (5) supporting at least one lateral wall panel (8) and at least one panel (12) for a roof structure (9) and projecting outward to define a covered space (7), wherein the at least one wall panel (8) is a longitudinal separating wall (29) located along a front surface of the waiting and boarding-disembarking station designed to face one of the street and the track (3);

the longitudinal separating wall (29) is designed to be place near the track (3) in order to prohibit passage between this longitudinal wall (29) and the track;

the longitudinal separating wall (29) does not completely block the front surface of the station and has at least one opening which constitutes a vehicle access threshold (22) for passenger use;

a portion of the covered space (7), bordered by the longitudinal separating wall (29), forms a waiting area protecting at least one passenger waiting from the track; and the station is at least partially open along at least one surface, other than its front surface, which allows people passing from one of the sidewalk (2) and the platform to enter the waiting and boarding-disembarking station.

* * * * *